US007245849B2

(12) United States Patent
Penke et al.

(10) Patent No.: US 7,245,849 B2
(45) Date of Patent: Jul. 17, 2007

(54) MODULAR WORK SURFACE OF AN IMAGE FORMING APPARATUS

(75) Inventors: Mark S. Penke, West Henrietta, NY (US); Donald A. Brown, Honeoye Falls, NY (US)

(73) Assignee: Xerox Corporation, Stamford, CT (US)

( * ) Notice: Subject to any disclaimer, the term of this patent is extended or adjusted under 35 U.S.C. 154(b) by 234 days.

(21) Appl. No.: 11/086,388

(22) Filed: Mar. 23, 2005

(65) Prior Publication Data

US 2006/0216058 A1 Sep. 28, 2006

(51) Int. Cl.
*G03G 15/00* (2006.01)

(52) U.S. Cl. ..... 399/107; 399/110

(58) Field of Classification Search ..... 399/107, 399/110, 118, 405, 407
See application file for complete search history.

(56) References Cited

U.S. PATENT DOCUMENTS

| | | | | |
|---|---|---|---|---|
| 4,721,382 | A * | 1/1988 | Ito et al. | 399/405 |
| 5,969,828 | A * | 10/1999 | Kawasaki et al. | |
| D483,800 | S | 12/2003 | Penke et al. | |
| D484,177 | S | 12/2003 | Penke et al. | |
| D484,178 | S | 12/2003 | Penke et al. | |
| D484,179 | S | 12/2003 | Penke et al. | |
| D484,180 | S | 12/2003 | Penke et al. | |
| D484,181 | S | 12/2003 | Penke et al. | |
| D484,182 | S | 12/2003 | Penke et al. | |
| D484,529 | S | 12/2003 | Penke et al. | |
| D484,531 | S | 12/2003 | Penke et al. | |
| D484,907 | S | 1/2004 | Penke et al. | |
| D485,295 | S | 1/2004 | Penke et al. | |
| 6,741,818 | B1 | 5/2004 | Penke et al. | |
| 7,019,870 | B2 * | 3/2006 | Kameyama et al. | 399/110 |
| 7,062,196 | B2 * | 6/2006 | Nanno | 399/107 |
| 2001/0048831 | A1 * | 12/2001 | Matsumoto et al. | 399/405 |
| 2005/0158096 | A1 * | 7/2005 | Park et al. | 399/405 |

* cited by examiner

*Primary Examiner*—Susan Lee
(74) *Attorney, Agent, or Firm*—Oliff & Berridge, PLC

(57) ABSTRACT

A image forming apparatus for providing an enlarged user work space. The image forming apparatus includes a printing module with a housing, a scanning module positioned above the printing module, a modular work surface positioned above the printing module, and a document handler positioned above the modular work surface. The modular work surface includes at least a unitary central work surface. The central work surface includes a top surface having a width dimension extending in a horizontal sheet feed direction, the width dimension of the top surface of the central work surface being larger than a width dimension of the housing of the printing module.

19 Claims, 5 Drawing Sheets

MODULAR WORK SURFACE OF AN IMAGE FORMING APPARATUS

BACKGROUND

This disclosure relates to a work surface of an image forming apparatus.

Image forming apparatus such as photocopiers, printers, multi-functional devices, scanners, and other image capture devices and image producing devices have been widely used in commercial and industrial environments having limited floor space for installation. Higher demands to minimize a floor space occupied by an image forming apparatus created a need by image forming apparatus manufacturers to reduce a size of the apparatus's static footprint, i.e., the floor space that the apparatus occupies. The need for the reduction of the static footprint has resulted in the development of compact image forming apparatus that maximize a vertical spatial area occupied by the apparatus, such as vertical feed type image forming apparatus.

A vertical feed type image forming apparatus generally involves a layered structure including a sheet supply tray portion, an image forming portion, a scanner and a document handler/feeder that are sequentially arranged to feed/convey paper along a vertical sheet feed path extending from a bottom to a top of the apparatus. Such vertical feed type image forming apparatus reduced the static footprint.

There are various existing types of vertical feed type image forming apparatus. For example, FIG. 1 shows a conventional vertical feed type image forming apparatus. The vertical feed type image forming apparatus 100 includes sheet supply trays 110*a*-110*c*, a printing module 120 as the image forming portion, a scanner module 130 as a image capture device, a top planar work surface 140 and a document handler/feeder 150 that collectively produce a static footprint $S_{100}$ of the printing module 120, as measured along a horizontal sheet feed direction indicated by arrow $F_{100}$. The vertical feed type image forming apparatus 100 also includes additional features of an assembler/finisher module 200, attachments/wings 300, a display module 400, a paper input tray 500 and a paper output tray 600 that collectively produce a dynamic footprint $D_{100}$ of the entire image forming apparatus 100, as measured along the direction of arrow $F_{100}$. Since the work surface 140 is predominately occupied by the overlying document handler/feeder 150, the additional attachments/wings 300 may be provided to extend the work surface 140 to expand the limited available working areas, i.e., areas not occupied by the document handler/feeder 150. Therefore, the user of the image forming apparatus 100 may perform other operations such as placing documents, copies, clips, pens, etc. on the wings, even if a separate work table is not available.

U.S. Pat. No. 6,741,818 describes another conventional vertical feed type image forming apparatus. The vertical feed type image forming apparatus is a multifunctional printer including a print module housing a main print engine and a scanning module, a central work surface provided above the print module and sandwiched between top surfaces of additional accessories, and a document feeder/handler provided above the central work surface. Since the central work surface is predominately occupied by the overlying document feeder/handler, the top surfaces of the accessories constitute the few unoccupied working spaces available for users of the multifunctional printer.

SUMMARY

Thus, the development of compact vertical feed type image forming apparatus reduced the static footprint of the apparatus, as well as the amount of available working areas for the users of the apparatus. However, such reduction of the static footprint and the available working area is limited by at least two main factors.

The first factor limiting the static footprint and the working area is a maximum size of a recording sheet/substrate to be positioned in a sheet supply tray, received on a platen of the scanner, and/or handled by the document handler/feeder of the image forming apparatus. Because the size of the platen and the size of the document handler/feeder are dictated by the maximum-sized sheet, the platen of the scanner and the document handler/feeder occupies a large portion of a top planar work surface of the image forming apparatus. Occupation of the top planar work surface by the platen and the document handler/feeder reduces the static footprint and the available working area of the top planar work surface.

The second factor limiting the static footprint and the working area is a structural requirement for aligning an optical scanner with an image forming portion of the image forming apparatus. In an image forming apparatus including an optical scanner, the optical scanner must be vertically aligned with the image forming portion in order to optically transfer an image onto a recording sheet. As a result of positioning the scanner directly above the image forming portion, the platen of the scanner and the overlying document handler/feeder occupy a large area of a top planar work surface of the image forming apparatus. Therefore, an amount of available working space for the user is very limited.

Because an increase in the available work space is desirable, additional features such as wings, finishers and the like may be added to a compact vertical image forming apparatus. However, these additional features are added costs to the image forming apparatus. Although these additional features appear to significantly increase the size of the footprint of the image forming apparatus, they actually utilize space provided by an initial dynamic footprint of the image forming apparatus.

The initial dynamic footprint of the image forming apparatus is larger than, and includes, the static footprint. In addition to the static footprint, the initial dynamic footprint includes a combination of individual footprints created by additional features connected to at least a housing of the printing module. These features may include a removable paper tray extender, and/or opening doors or side covers for purposes of maintenance, loading toner, loading paper and the like. In order to fully utilize such additional features, consideration of the dynamic footprint created by such features is required for installation of the image forming apparatus. Therefore, sufficient floor space is needed to compensate for at least the initial dynamic footprint of the image forming apparatus having a reduced static footprint. Therefore, it is desirable that the space provided by at least the initial dynamic footprint can be effectively utilized for an image forming apparatus including an optical scanner or a digital scanner.

An image forming apparatus including a digital scanner eliminates the need for vertical alignment of the scanner with the image forming portion because scanned images are digitally transferred, for example, through a wire to the image forming portion, and onto a recording sheet. Although an operable digital scanner may be positioned almost anywhere, conventional vertical image forming apparatus continue to vertically align the digital scanner and the image forming portion to create a reduced static footprint, without recognizing the advantages of efficiently using the space provided by at least the initial dynamic footprint. Therefore, it would be desirable to provide an image forming apparatus having a maximum available contiguous, working area for the user that fully utilizes a space provided by at least the initial dynamic footprint of the image forming apparatus.

Various exemplary embodiments of an image forming apparatus may provide a modular work surface that efficiently utilizes at least an initial dynamic footprint and helps maximize an available work area for a user of the image forming apparatus.

Exemplary embodiments of an image forming apparatus may provide a modular work surface including at least one unitary central work surface that increases the static footprint without necessarily increasing a maximum dynamic footprint of the image forming apparatus.

Exemplary embodiments of an image forming apparatus may include a printing module including a housing with at least a width dimension extending in a horizontal sheet feed direction, a scanning module positioned above the printing module, a substantially planar modular work surface positioned above the printing module, the modular work surface including at least a unitary central work surface, and a document handler positioned above the modular work surface, wherein the central work surface includes a top surface having at least a width dimension extending in the horizontal sheet feed direction, the width dimension of the top surface of the central work surface being larger than the width dimension of the housing of the printing module.

The central work surface may also include a central axis that is vertically aligned with a central axis of the printer module, the central axis of the central work surface and the central axis of the printer module extending in a direction substantially perpendicular to the horizontal sheet feed direction.

The central work surface may further include a central axis that is out of vertical alignment with a central axis of the printer module, the central axis of the central work surface and the central axis of the printer module extending in a direction substantially perpendicular to the horizontal sheet feed direction.

The modular work surface may include at least one modular extension connected to the central work surface, the modular extension having a substantially planar top surface that is aligned with the top surface of the central work surface and horizontally extends the modular work surface.

The modular extension may also include a top surface of an added accessory or feature such as an adjacent top surface of a finisher, a top surface of a sheet supply tray and the like that horizontally extends the modular work surface.

The document handler and the scanning module may also include central axes that are vertically aligned with a central axis of the printer module, the central axis of the document handler, the central axis of scanning module and the central axis of the printer module extending in a direction substantially perpendicular to the horizontal sheet feed direction.

The document handler and the scanning module may also include central axes that are out of vertical alignment with a central axis of the printer module, the central axis of the document handler, the central axis of scanning module and the central axis of the printer module extending in a direction substantially perpendicular to the horizontal sheet feed direction.

The scanning module may also be positioned in at least one of above the top surface of the central work surface, partially contained within the central work surface, below a bottom surface of the central work surface, and the like.

The document handler may also be provided on a first area located on the top surface of the central work surface, the first area being smaller than a total area of the top surface of the central work surface.

The scanning module may include at least one of a digital scanner and an optical scanner.

The image forming apparatus may also form part of a xerographic device or any other image forming system.

Exemplary embodiments of an image forming apparatus may include a printing module including a housing that forms a static footprint and a dynamic footprint of the housing, a scanning module positioned above the printing module, a substantially planar modular work surface positioned above the printing module, the modular work surface including at least a unitary central work surface that forms a static footprint of the central work surface, and a document handler positioned above the modular work surface, wherein the static footprint of the central work surface is larger than the static footprint of the housing of the printing module.

The static footprint of the central work surface may be substantially equal to the initial dynamic footprint of the housing of the printing module.

Exemplary embodiments of an image forming apparatus may include a printing module including a housing that forms a static footprint and a dynamic footprint of the housing, at least one of a finishing module, a stacking module and a sheet supplying module operatively connected to the printing module to form a second dynamic footprint, a scanning module positioned above the printing module, a substantially planar modular work surface positioned above the printing module, the modular work surface including at least a unitary central work surface that forms a static footprint of the central work surface, and a document handler positioned above the modular work surface, wherein the static footprint of the central work surface is larger than the dynamic footprint of the housing and the second dynamic footprint.

These and other features are described in or are apparent from the following detailed description.

BRIEF DESCRIPTION OF THE DRAWINGS

Various exemplary details are described herein, with reference to the following figures, wherein like numerals refer to like parts, and wherein.

DETAILED DESCRIPTION OF EXEMPLARY EMBODIMENTS

The following detailed description is directed to a modular work surface of a specific type of image forming apparatus, namely a multifunctional device including a scanner and a printer.

However, it should be appreciated that the description is for ease of understanding and familiarity only, and does not exclude other types of age forming apparatus, whether known or later developed.

Figure 1:
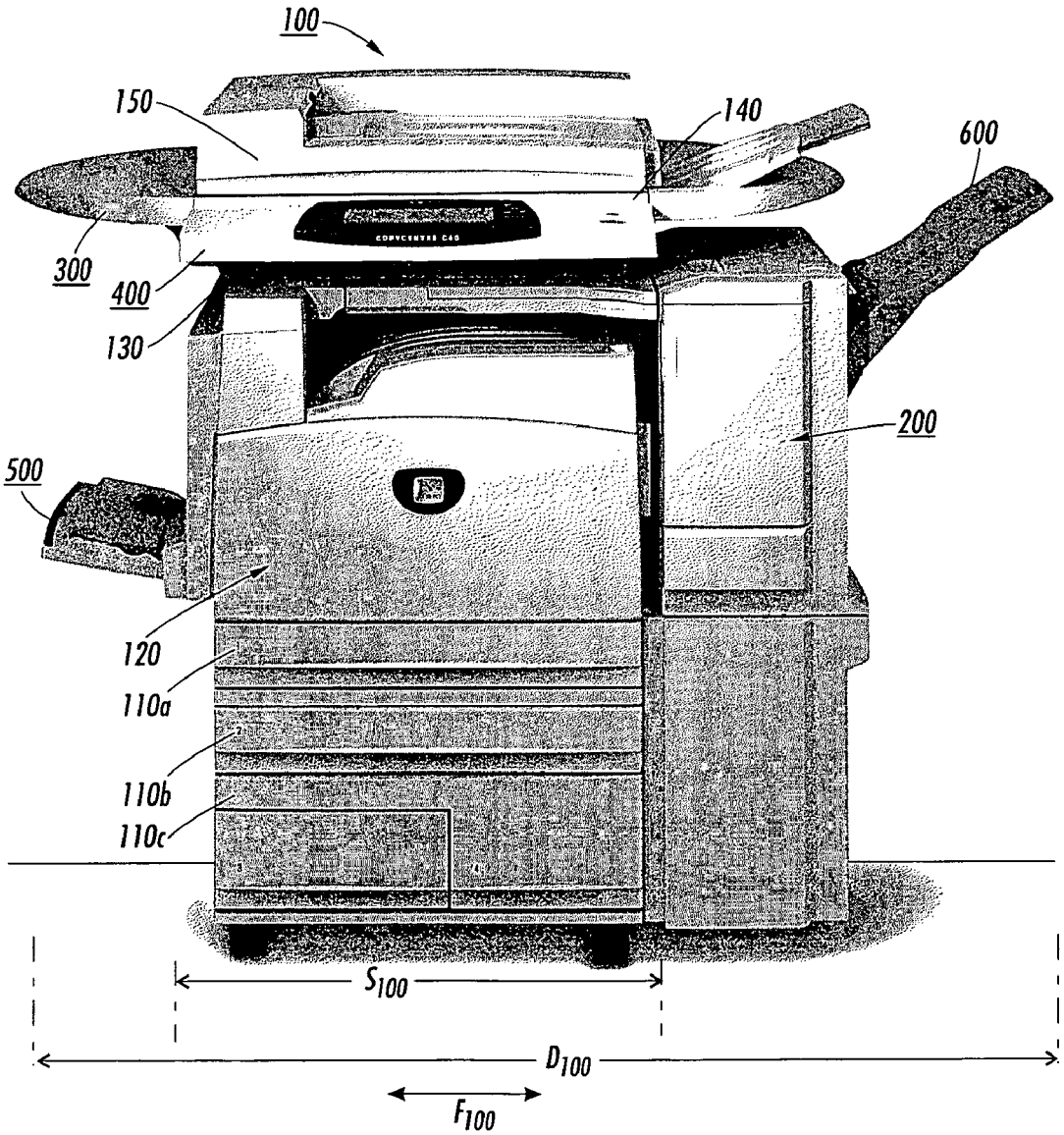
FIG. 1 RELATED ART
FIG. 1 is a front view of a conventional image forming apparatus.
Figure 2:
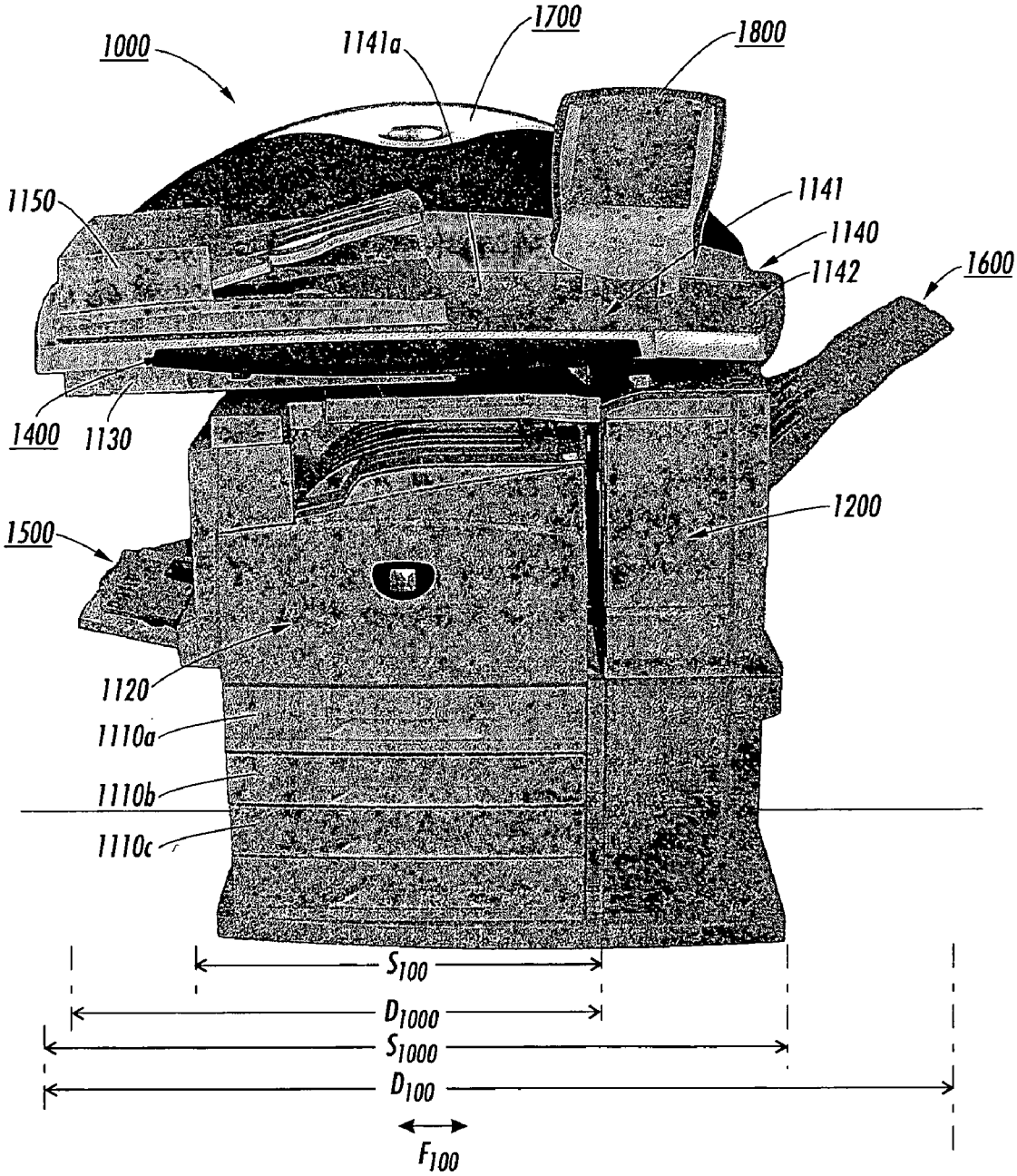
FIG. 2 is a perspective view of an exemplary modular work surface of an image forming apparatus.

FIG. 2 is a perspective view of an exemplary modular work surface of an image forming apparatus 1000. The image forming apparatus 1000 includes sheet supply trays 110*a*-110*c*, a printing module 1120 as an image forming portion, a scanner module 1130 as an image capture device and a paper tray extender 1500 that together produce an initial dynamic footprint $D_{1000}$ of the printer module 1120. The initial dynamic footprint $D_{1000}$ is measured along the horizontal sheet feed direction indicated by arrow $F_{100}$ and includes the static footprint $S_{100}$ of the printing module.

As shown in FIG. 2, the image forming apparatus 1000 also includes a top planar modular work surface 1140 that produces a static footprint $S_{1000}$ of the image forming apparatus 1000, which may be greater than or substantially equal to the initial dynamic footprint $D_{1000}$ of the printing module 1120. The enlarged modular work surface 1140 may include a central unitary work surface 1141 that provides a larger available work area 1141 a, i.e., free space available for the user to work. Therefore, the initial dynamic footprint $D_{1000}$ of the printing module may be efficiently utilized.

The second dynamic footprint $D_{100}$ of the image forming apparatus 1000 may also be efficiently utilized. As shown in FIG. 2, the image forming apparatus 1000 may include additional features that form the second dynamic footprint $D_{100}$ of the image forming apparatus 1000. For example, a document handler/feeder 1150 having a separate paper tray extender 1600 may be operatively connected to an assembler/finisher 1200, and thus contribute to the second dynamic footprint $D_{100}$ of the image forming apparatus 1000. Further, a removable modular extension 1142 may be provided adjacent to the central unitary work surface 1141 to extend the modular work surface 1140. Although the second dynamic footprint $D_{100}$ of the entire image forming apparatus 1000 may be further increased, the available working area 1141*a* may be increased by the modular extension 1142 to provide more work space for the user and to efficiently utilize a space provided by the second dynamic footprint $D_{100}$.

As shown in FIG. 2, the static footprint $S_{1000}$ of the image forming apparatus 1000 is defined by a width of the modular work surface 1140, e.g., including the central work surface 1141 and the modular extension 1142, that is centrally positioned with respect to the printing module 1120. However, the modular work surface 1140 may be positioned at various locations with respect to a central axis $A_P$ of the printing module 1120 extending perpendicular to the horizontal sheet feed direction $F_{100}$.

Figure 3:
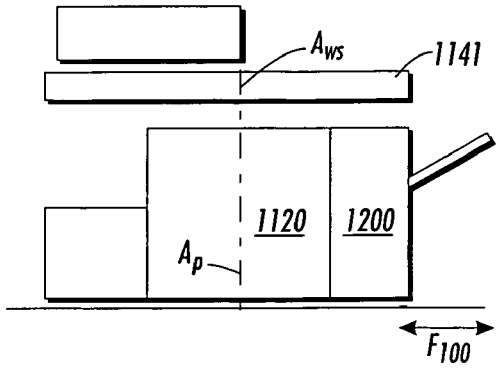
FIG. 3 is a front schematic view of an exemplary positional relationship of the modular work surface and the printing module of an image forming apparatus.
Figure 4:
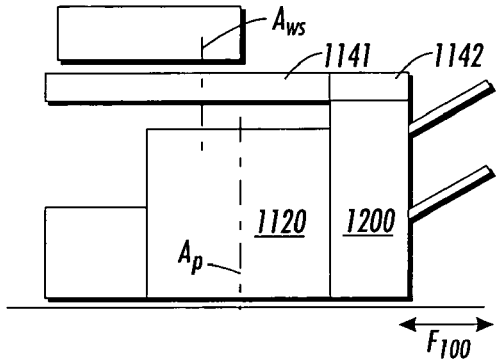
FIG. 4 is a front schematic view of another exemplary positional relationship of the modular work surface and the printing module of an image forming apparatus.
Figure 5:
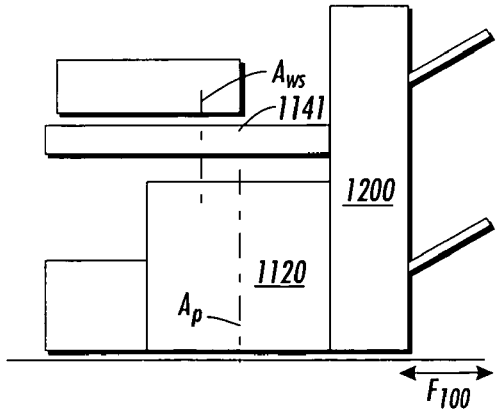
FIG. 5 is a front schematic view of another exemplary positional relationship of the modular work surface and the printing module of an image forming apparatus.

FIGS. 3-5 are front schematic views of exemplary positional relationships of the modular work surface 1140 and the printing module 1120 of the image forming apparatus 1000.

As shown in FIG. 3, a central axis $A_{WS}$ of the central work surface 1141 may be aligned with respect to the central axis $A_P$ of the printing module 1120. As a result, the static footprint $S_{1000}$ of the image forming apparatus 1000 may create a larger available working area 1141*a* for a user while efficiently utilizing at least the initial dynamic footprint $D_{100}$ of the printer module. Other positional relationships of the modular work surface 1140 and the printing module 1120 may provide similar results.

As shown in FIG. 4, for example, the central axis $A_{WS}$ of the central work surface 1141 may be offset with respect to the central axis $A_P$ of the printing module 1120. The modular extension 1142 may be provided adjacent to the unitary work surface 1141 to extend the modular workspace 1140 and accommodate a shorter assembler/finisher 1200. Although the modular extension 1142 is shown as a separate attachment to the document handler/feeder 1200, it should be appreciated that the modular extension may include a top surface of the assembler/finisher 1200.

By forming the modular work surface 1140, additional features of various sizes may be operatively connected to the image forming apparatus 1000 without substantially increasing a space provided by the dynamic footprint $D_{1000}$. As a result, the static footprint $S_{1000}$ of the image forming apparatus 1000 may create a larger available working area 1141*a* for a user while efficiently utilizing at least the initial dynamic footprint $D_{100}$ of the printer module.

As shown in FIG. 5, for example, the central axis $A_{WS}$ of the central work surface 1141 may be offset with respect to a central axis $A_P$ of the printing module 1120. However, a modular extension 1142 may not be provided in this exemplary embodiment in order to accommodate a larger assembler/finisher 1200. As a result, the static footprint $S_{1000}$ of the image forming apparatus 1000 may create a larger available working area 1141*a* for a user while efficiently utilizing at least the initial dynamic footprint $D_{100}$ of the printer module.

By enlarging the modular work surface 1140 to create the larger static footprint $S_{1000}$ of the image forming apparatus 1000, a larger available work area 1141*a*, e.g., an area not occupied by the document handler/feeder 1150, may be provided on the modular work surface 1140. Therefore, the available work area 1141*a* may be maximized within boundaries of the initial dynamic footprint $D_{100}$ of the printing module 1120 and the dynamic footprint $D_{1000}$ of the image forming apparatus 1000.

As discussed above, the dynamic footprint $D_{100}$ of the image forming apparatus may also be increased and defined by additional features, such as a display module 1400, as shown in FIG. 2. The image forming apparatus 1000 may also include additional features, such as a rear messaging wall 1700 and/or a user interface 1800, that do not increase either the static footprint $S_{1000}$ or the dynamic footprint $D_{1000}$ of the image forming apparatus 1000, as shown in FIG. 2. Alternatively or additionally, the image forming apparatus 1000 may include various placements of the document handler/feeder 1150 and the scanning module 1130 with respect to the printing module 1120, without reducing the available work area 1141*a*.

Figure 6A:
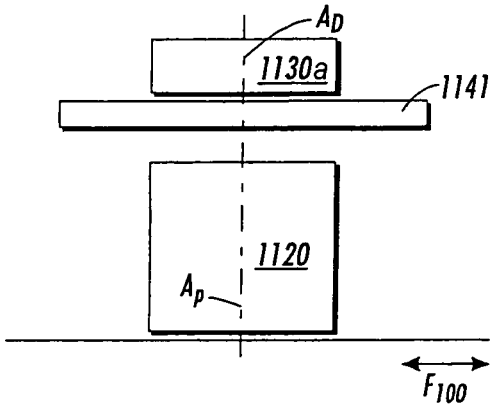
FIGS. 6A and 6B are front schematic views of an exemplary positional relationship of a scanner module with an optical scanner and digital scanner, a document handler/feeder module, and a printing module of an image forming apparatus.
Figure 6B:
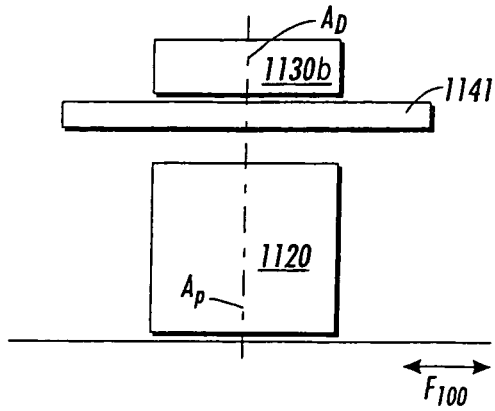
Figure 7:
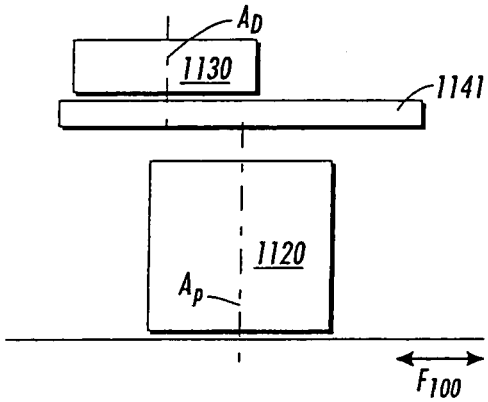
FIG. 7 is a front schematic view of another exemplary positional relationship of the scanner module, the document handler/feeder module, and the printing module of an image forming apparatus.
Figure 8:
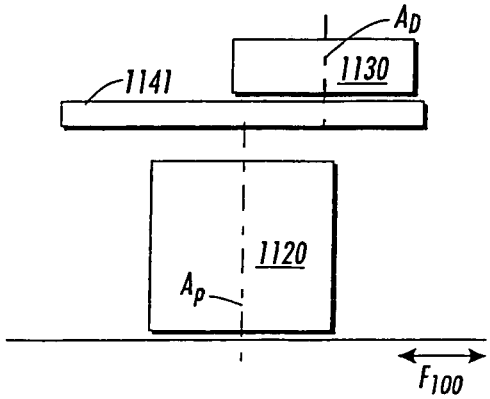
FIG. 8 is a front schematic view of another exemplary positional relationship of the scanner module, the document handler/feeder module, and the printing module of an image forming apparatus.

FIGS. 6-8 are front schematic views of exemplary positional relationships of the scanner module 1130, the document handler/feeder 1150, and the printing module 1120 of an image forming apparatus.

As shown in FIG. 6A and FIG. 6B, a central axis $A_D$ of the scanner module 1130 and the document handler/feeder 1150 may be aligned with respect to the central axis $A_P$ of the printing module 1120. This positional relationship may apply to both a scanner module with an optical scanner 1130*a* and a scan module with a digital scanner 1130*b*.

As shown in FIG. 7, the central axis $A_D$ of the scanner module 1130 and the document handler/feeder 1150 may be offset on a left-hand side with respect to a central axis $A_P$ of the printing module 1120. As discussed above, this positional relationship does not apply to optical scanners due to structural requirements of vertically aligning an optical scanning module with a printing module.

As shown in FIG. 8, the central axis $A_D$ of the scanner module 1130 and the document handler/feeder 1150 is offset on a right-hand side with respect to a central axis $A_P$ of the printing module 1120. As discussed above, this positional relationship does not apply to optical scanners due to structural requirements of vertically aligning an optical scanning module with a printing module.

By variously positioning the scanner module 1130 and the document handler/feeder 1150 on the central work surface 1141 with respect to the central axis $A_P$ of the printing module 1120, the available work area 1141*a* of the unitary central work surface 1141 may be variously distributed, without increasing either the static footprint $S_{1000}$ or the dynamic footprint $D_{1000}$ of the image forming apparatus 1000, and/or without reducing an amount of the available work area 1141*a*.

Figure 9:
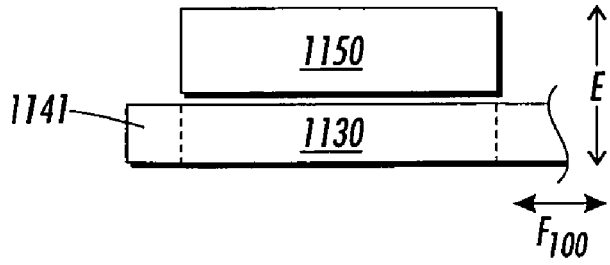
FIG. 9 is a front schematic view of an exemplary positional relationship of the scanner module and a unitary central work surface of an image forming apparatus.
Figure 10:
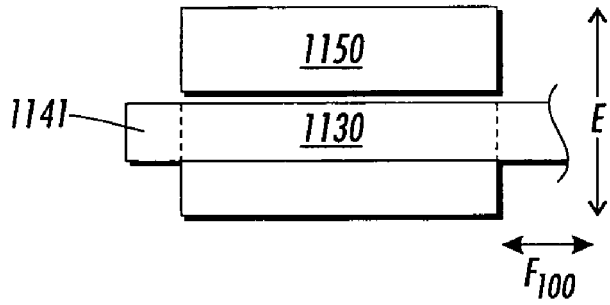
FIG. 10 is a frontal schematic view of another exemplary positional relationship of the scanner module and the unitary central work surface of an image forming apparatus.
Figure 11:
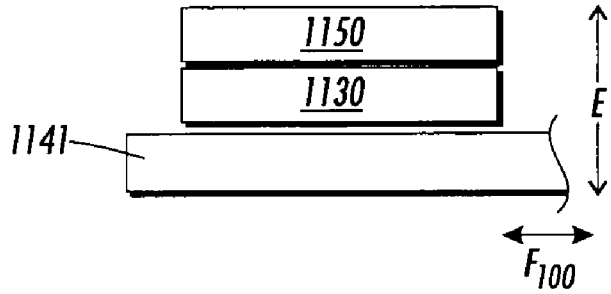
FIG. 11 is a frontal schematic view of another exemplary positional relationship of the scanner module and the unitary central work surface of an image forming apparatus.

The total amount of the available work area 1141*a* may also be maintained by variously positioning the scanner module 1130 with respect to the central work surface 1141 along a vertical directional arrow E. FIGS. 9-11 are front schematic views of exemplary positional relationships of the scanner module 1130 and the unitary central work surface 1141 of an image forming apparatus.

As shown in FIG. 9, the scanner module 1130 may be fully contained in the unitary central work surface 1141. As shown in FIG. 10, the scanner module 1130 may be partially contained in the unitary central work surface 1141, e.g., a platen may be positioned in the unitary central work surface 1141. As shown in FIG. 11, the scanner module 1130 may be fully positioned above a topmost surface of the unitary central work surface 1141. The vertical positioning of the scanning module may be applied to both optical scanners and digital scanners.

Various details have been described in conjunction with exemplary implementations outlined above. Various alternatives, modifications, variations, and/or improvements, whether known or presently unforeseen, are possible.

For example, while the illustrative examples of the work surface and the display module are of rectangular configuration, it is possible that the top planar work surface and the display module are configured in any shape that extends beyond a static footprint of an underlying printing module to create a work zone that the takes advantage of the flexibility of the dynamic and static footprint of modular components.

It will be appreciated that various of the above-disclosed and other features and functions, or alternatives thereof, may be desirably combined into many other different systems or applications.

Also, various presently unforeseen or unanticipated alternatives, modifications, variations or improvements therein may be subsequently made by those skilled in the art which are also intended to be encompassed by the following claims.

What is claimed is:

1. An image forming apparatus, comprising:

a printing module including a housing that forms a static footprint and a dynamic footprint of the housing;

a scanning module positioned above the printing module;

a substantially planar modular work surface positioned above the printing module, the modular work surface including at least a unitary central work surface that forms a static footprint of the central work surface; and a document handler positioned above the modular work surface, wherein the static footprint of the central work surface is larger than the static footprint of the housing of the printing module.

2. The image forming apparatus of claim 1, wherein the static footprint of the central work surface is substantially equal to the dynamic footprint of the housing of the printing module.

3. The image forming apparatus of claim 1, wherein the modular work surface includes at least a modular extension connected to the central work surface, the modular extension having a substantially planar top surface that is aligned with a top surface of the central work surface and horizontally extends the modular work surface to form a dynamic footprint of the modular work surface.

4. The image forming apparatus of claim 3, wherein the dynamic footprint of the central work surface is substantially equal to the dynamic footprint of the housing of the printing module.

5. The image forming apparatus of claim 1, wherein the document handler is provided on a first area located on a top surface of the central work surface, the first area being smaller than a total area of the top surface of the central work surface.

6. The image forming apparatus of claim 1, wherein the scanning module comprises at least one of a digital scanner and an optical scanner.

7. A xerographic device comprising the image forming apparatus of claim 1.

8. An image forming apparatus, comprising:

a printing module including a housing with at least a width dimension extending in a horizontal sheet feed direction;

a scanning module positioned above the printing module;

a substantially planar modular work surface positioned above the printing module, the modular work surface including at least a unitary central work surface; and a document handler positioned above the modular work surface, wherein the central work surface includes a top surface with at least a width dimension extending in the horizontal sheet feed direction, the width dimension of the top surface of the central work surface being larger than the width dimension of the housing of the printing module, and wherein the document handler is provided on a first area located on the top surface of the central work surface, the first area being smaller than a total area of the top surface of the central work surface.

9. The image forming apparatus of claim 8, wherein a central axis of the central work surface is vertically aligned with a central axis of the printing module, the central axis of the central work surface and the central axis of the printing module extending in a direction substantially perpendicular to the horizontal sheet feed direction.

10. The image forming apparatus of claim 8, wherein a central axis of the central work surface and a central axis of the printing module are out of vertical alignment, the central axis of the central work surface and the central axis of the printing module extending in a direction substantially perpendicular to the horizontal sheet feed direction.

11. The image forming apparatus of claim 8, wherein the modular work surface includes at least a modular extension connected to the central work surface, the modular extension having a substantially planar top surface that is aligned with the top surface of the central work surface and horizontally extends the modular work surface.

12. The image forming apparatus of claim 8, wherein a central axis of the document handler and a central axis of the scanning module are vertically aligned with a central axis of the printing module, the central axis of the document handler, the central axis of scanning module and the central axis of the printing module extending in a direction substantially perpendicular to the horizontal sheet feed direction.

13. The image forming apparatus of claim 8, wherein a central axis of the document handler, a central axis of the scanning module and a central axis of the printing module are out of vertical alignment, the central axis of the document handler, the central axis of scanning module and the central axis of the printing module extending in a direction substantially perpendicular to the horizontal sheet feed direction.

14. The image forming apparatus of claim 8, wherein the scanning module is at least one of positioned above the top surface of the central work surface, partially contained within the central work surface, and positioned below a bottom surface of the central work surface.

15. The image forming apparatus of claim 8, wherein the modular work surface includes at least a modular extension connected to the central work surface, the modular extension having a substantially planar top surface that is aligned with the top surface of the central work surface and extends the modular work surface.

16. The image forming apparatus of claim 8, wherein the scanning module comprises a digital scanner.

17. The image forming apparatus of claim 8, wherein the scanning module comprises an optical scanner.

18. A xerographic device comprising the image forming apparatus of claim 8.

19. An image forming apparatus, comprising:

a printing module including a housing that forms a static footprint and a dynamic footprint of the housing;

at least one of a finishing module, a stacking module and a sheet supplying module operatively connected to the printing module to form a second dynamic footprint;

a scanning module positioned above the printing module;

a substantially planar modular work surface positioned above the printing module, the modular work surface including at least a unitary central work surface that forms a static footprint of the central work surface; and a document handler positioned above the modular work surface, wherein the static footprint of the central work surface is larger than the dynamic footprint of the housing and smaller than the second dynamic footprint.

* * * * *